US006893214B2

(12) United States Patent
Alford et al.

(10) Patent No.: US 6,893,214 B2
(45) **Date of Patent: *May 17, 2005**

(54) SHROUD SEGMENT AND ASSEMBLY WITH SURFACE RECESSED SEAL BRIDGING ADJACENT MEMBERS

(75) Inventors: Mary Ellen Alford, Cincinnati, OH (US); Toby George Darkins, Loveland, OH (US); Mark Eugene Noe, Morrow, OH (US)

(73) Assignee: General Electric Company, Schenectady, NY (US)

( * ) Notice: Subject to any disclaimer, the term of this patent is extended or adjusted under 35 U.S.C. 154(b) by 147 days.

This patent is subject to a terminal disclaimer.

(21) Appl. No.: 10/325,779

(22) Filed: Dec. 20, 2002

(65) Prior Publication Data

US 2004/0120808 A1 Jun. 24, 2004

(51) Int. Cl.[7] ..... F01D 11/08

(52) U.S. Cl. ..... 415/138; 415/139; 415/173.1; 415/200

(58) Field of Search ..... 415/136, 138, 415/139, 135, 173.1, 173.3, 200; 277/628, 630, 637, 643

(56) References Cited

U.S. PATENT DOCUMENTS

| | | | | | |
|---|---|---|---|---|---|
| 3,798,899 | A | | 3/1974 | Hill | |
| 3,807,891 | A | | 4/1974 | McDow et al. | |
| 3,966,353 | A | | 6/1976 | Booher, Jr. et al. | |
| 4,193,738 | A | | 3/1980 | Landis, Jr. et al. | |
| 4,325,647 | A | | 4/1982 | Maier et al. | |
| 4,768,924 | A | | 9/1988 | Carrier et al. | |
| 5,071,313 | A | | 12/1991 | Nichols | |
| 5,074,748 | A | | 12/1991 | Hagle | |
| 5,127,793 | A | | 7/1992 | Walker et al. | |
| 5,129,783 | A | | 7/1992 | Hayton | |
| 5,387,082 | A | * | 2/1995 | Matyscak | 415/139 |
| 5,388,962 | A | | 2/1995 | Wygle et al. | |
| 5,562,408 | A | | 10/1996 | Proctor et al. | |
| 6,000,906 | A | | 12/1999 | Draskovich | |
| 6,113,349 | A | * | 9/2000 | Bagepalli et al. | 415/139 |
| 6,142,734 | A | | 11/2000 | Lee | |
| 6,325,593 | B1 | * | 12/2001 | Darkins et al. | 415/115 |
| 6,412,784 | B1 | * | 7/2002 | Cohen | 277/385 |
| 6,503,051 | B2 | * | 1/2003 | Predmore | 415/135 |
| 6,554,563 | B2 | * | 4/2003 | Noe et al. | 415/115 |
| 6,648,597 | B1 | * | 11/2003 | Widrig et al. | 415/200 |
| 2003/0133790 | A1 | * | 7/2003 | Darkins et al. | 415/139 |
| 2003/0185674 | A1 | * | 10/2003 | Alford et al. | 415/173.1 |

* cited by examiner

*Primary Examiner*—Christopher Verdier
(74) *Attorney, Agent, or Firm*—David L. Narciso; Lee H. Sachs

(57) ABSTRACT

A turbine engine shroud segment is provided with a radially outer surface including a pair of spaced apart, opposed first and second edge portion surface depressions, for example spaced circumferentially, having a seal surface shaped to receive, in a surface depression formed between assembled adjacent segments in a shroud assembly, or axially assembled adjacent segments and engine members, a radially outer fluid seal member. The depression portions of a shroud segment are joined with the radially outer surface of the shroud segment through an arcuate transition surface. Stresses generated during engine operation in the shroud material are reduced, enabling practical use of a low ductility material, for example a ceramic matrix composite. The edge portion surface depressions are provided with a first shape and the fluid seal member, disposed at the depression, is provided with a surface of a second shape matched in shape with the first shape.

11 Claims, 3 Drawing Sheets

SHROUD SEGMENT AND ASSEMBLY WITH SURFACE RECESSED SEAL BRIDGING ADJACENT MEMBERS

The Government has rights in this invention pursuant to Contract No. F33615-97-C-2778 awarded by the Department of Air Force.

BACKGROUND OF THE INVENTION this invention relates generally to turbine engine shrouds disposed about rotating articles and to their assemblies about rotating blades. More particularly, it relates to air cooled gas turbine engine shroud segments and to shroud assemblies, for example used in the turbine section of a gas turbine engine, especially segments made of a low ductility material.

Typically in a gas turbine engine, a plurality of stationary shroud segments are assembled circumferentially about an axial flow engine axis and radially outwardly about rotating blading members, for example about turbine blades, to define a part of the radial outer flowpath boundary over the blades. In addition, the assembly of shroud segments is assembled in an engine axially between such axially adjacent engine members as nozzles and/or engine frames. As has been described in various forms in the gas turbine engine art, it is desirable to avoid leakage of shroud segment cooling air radially inwardly and engine flowpath fluid radially outwardly through separations between circumferentially adjacent shroud segments and between axially adjacent engine members. It is well known that such undesirable leakage can reduce turbine engine operating efficiency. Some current seal designs and assemblies include sealing members disposed in slots in shroud segments. Typical forms of current shrouds often have slots along circumferential and/or axial edges to retain thin metal strips sometimes called spline seals. During operation, such spline seals are free to move radially to be pressure loaded at the slot edges and thus to minimize shroud segment to segment leakage. Because of the usual slot configuration, stresses are generated at relatively sharp edges. However as discussed below, current metallic materials from which the shroud segments are made can accommodate such stresses without detriment to the shroud segment. Examples of U.S. Patents relating to turbine engine shrouds and such shroud sealing include U.S. Pat. No. 3,798,899—Hill; U.S. Pat. No. 3,807,891—McDow et al.; U.S. Pat. No. 5,071,313—Nichols; U.S. Pat. No. 5,074,748—Hagle; U.S. Pat. No. 5,127,793—Walker et al.; and U.S. Pat. No. 5,562,408—Proctor et al.

Metallic type materials currently and typically used to make shrouds and shroud segments have mechanical properties including strength and ductility sufficiently high to enable the shrouds to receive and retain currently used inter-segment leaf or spline seals in slots in the shroud segments without resulting in damage to the shroud segment during engine operation. Generally such slots conveniently are manufactured to include relatively sharp corners or relatively deep recesses that can result in locations of stress concentrations, sometimes referred to as stress risers. That kind of assembly can result in the application of a substantial compressive force to the shroud segments during engine operation. If such segments are made of typical high temperature alloys currently used in gas turbine engines, the alloy structure can easily withstand and accommodate such compressive forces without damage to the segment. However, if the shroud segment is made of a low ductility, relatively brittle material, such compressive loading can result in fracture or other detrimental damage to the segment during engine operation.

Current gas turbine engine development has suggested, for use in higher temperature applications such as shroud segments and other components, certain materials having a higher temperature capability than the metallic type materials currently in use. However such materials, forms of which are referred to commercially as a ceramic matrix composite (CMC), have mechanical properties that must be considered during design and application of an article such as a shroud segment. For example, CMC type materials have relatively low tensile ductility or low strain to failure when compared with metallic materials. Therefore, if a CMC type of shroud segment is manufactured with features such as relatively sharp corners or deep recesses to receive and hold a fluid seal, such features can act as detrimental stress risers. Compressive forces developed at such stress risers in a CMC type segment can be sufficient to cause failure of the segment.

Generally, commercially available CMC materials include a ceramic type fiber for example SiC, forms of which are coated with a compliant material such as BN. The fibers are carried in a ceramic type matrix, one form of which is SiC. Typically, CMC type materials have a room temperature tensile ductility of no greater than about 1%, herein used to define and mean a low ductility material. Generally CMC type materials have a room temperature tensile ductility in the range of about 0.4–0.7%. This is compared with metallic materials currently used as shrouds, and supporting structure or hanger materials, that have a room temperature tensile ductility of at least about 5%, for example in the range of about 5–15%. Shroud segments made from CMC type materials, although having certain higher temperature capabilities than those of a metallic type material, cannot tolerate the above described and currently used type of compressive forces generated in slots or recesses for fluid seals. Therefore, a shroud segment and assembly of shroud segments configured to receive and hold an inter-segment fluid seal without generating detrimental stress can enable advantageous use of low ductility shroud segments with fluid seals retained therebetween without operating damage to the brittle segments.

BRIEF SUMMARY OF THE INVENTION

The present invention, in one form, provides a shroud segment for use in a turbine engine shroud assembly comprising a plurality of circumferentially disposed shroud segments. Each segment includes a shroud segment body having a radially outer surface extending at least between a pair of first and second spaced apart, opposed outer surface edge portions, for example circumferentially and/or axially spaced apart. In a pair, at least one of the first and second outer surface edge portions of a shroud segment includes a depression portion including a depression portion seal surface, of a first shape, generally along the depression portion and joined with the shroud body radially outer surface through an arcuate transition surface.

In a circumferential assembly of shroud segments, leakage between segments and/or between axially adjacent members is avoided by a sealing combination disposed in a depression on the radially outer surface of the segments rather than in slot-type recesses in the segments. In the assembly, the first edge portion of a shroud segment is distinct from a juxtaposed adjacent second member, for example a circumferentially adjacent shroud segment, by a separation therebetween. With circumferentially adjacent shroud segments, juxtaposed depression portions of shroud segments define therebetween a substantially axially extending surface depression. Disposed in the surface depression and bridging the separation is a fluid seal member. The fluid seal member includes a seal surface of a second shape matched in shape with the first shape of the depression portion seal surface of the shroud segment, and in juxtaposition for contact respectively with he depression portion seal surface, along the separation. One form of the invention includes a seal retainer to hold the flat surfaces of the shroud segments and of the seal member in juxtaposition.

DETAILED DESCRIPTION OF THE INVENTION

The present invention will be described in connection with an axial flow gas turbine engine for example of the general type shown and described in the above identified Proctor et al patent. Such an engine comprises a plurality of cooperating engine members and their sections in serial flow communication generally from forward to aft, including one or more compressors, a combustion section, and one or more turbine sections disposed axisymmetrically about a longitudinal engine axis. Accordingly, as used herein, phrases using the term "axially", for example "axially forward" and "axially aft", are general directions of relative positions in respect to the engine axis; phrases using forms of the term "circumferential" refer to circumferential disposition generally about the engine axis; and phrases using forms of the term "radial", for example "radially inner" and "radially outer", refer to relative radial disposition generally from the engine axis.

It has been determined to be desirable to use low ductility materials, such as the above-described CMC type materials, for selected articles or components of advanced gas turbine engines, for example non-rotating turbine shroud segments. However, because of the relative brittle nature of such materials, conventional mechanisms currently used for carrying fluid seals with metallic forms of such components cannot be used: relatively high mechanical, thermal and contact stresses can result in fracture of the brittle materials. Forms of the present invention provide article configurations and mechanisms for holding fluid seals to articles or components made of such brittle materials in a manner that avoids application of undesirable stresses to the article.

Forms of the present invention will be described in connection with an article in the form of a gas turbine engine turbine shroud segment, made of a low ductility material, and a circumferential assembly of shroud segments. Such assembly of shroud segments is disposed between generally axially adjacent engine members, for example between a turbine nozzle and an engine frame, between spaced apart turbine nozzles, etc. The fragmentary, diagrammatic perspective view of FIG. 1 includes a pair of turbine engine turbine shroud segments, each made of a CMC material, of a circumferential assembly of shroud segments shown generally at 10, in one embodiment of the present invention. A first shroud segment is shown generally at 12 and a second shroud segment is shown generally at 14. In the embodiments of the drawings, orientation of shroud segments 12 and 14 in a turbine engine, and of other adjacent engine members, is shown by engine direction arrows 16, 18, and 20 representing, respectively, the engine circumferential, axial, and radial directions.

Figure 1:
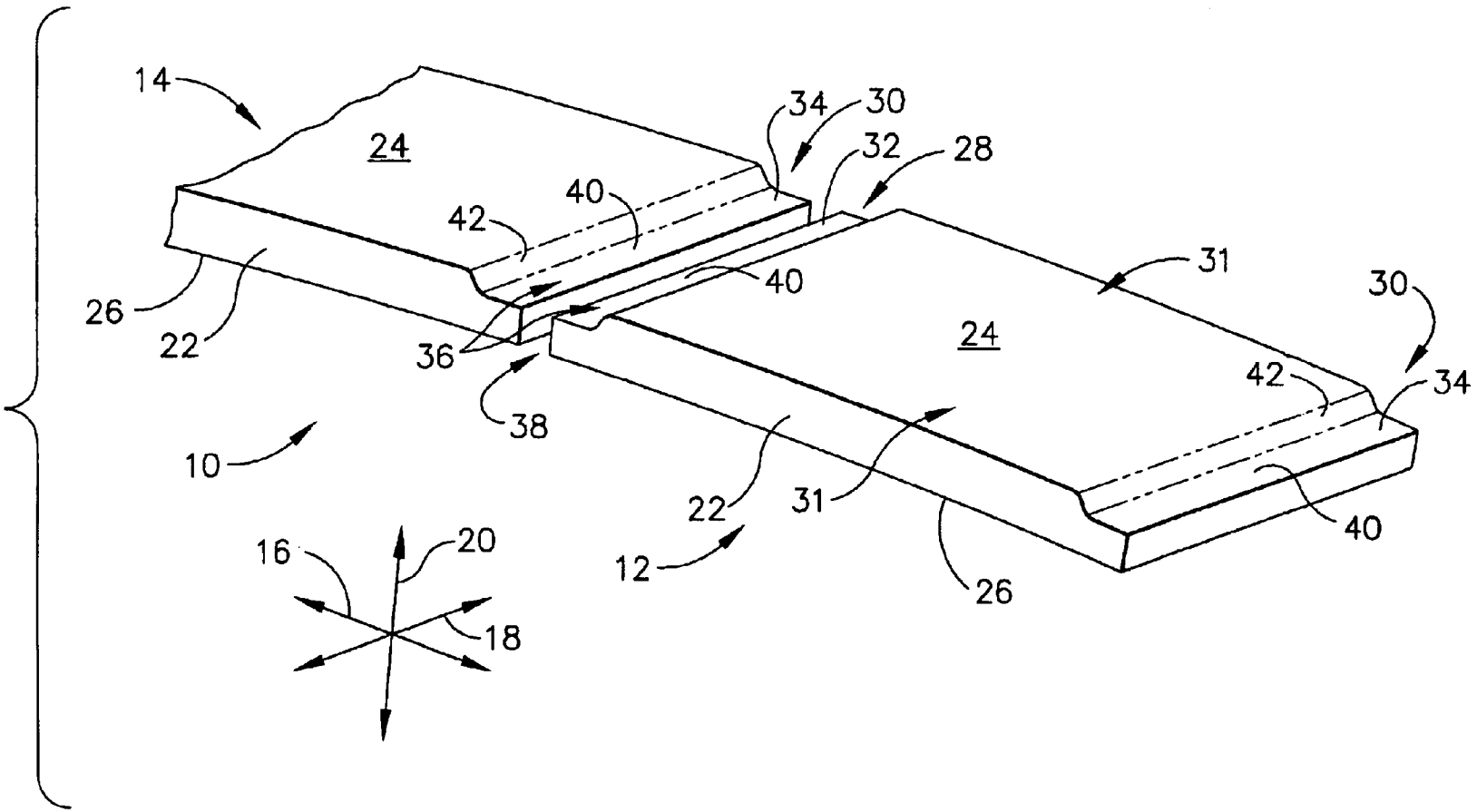
FIG. 1 is a fragmentary, diagrammatic perspective view of two adjacent shroud segments of a circumferential assembly of turbine engine shroud segments.

Each shroud segment, for example 12 and 14, includes a shroud body 22 having body radially outer surface 24 and a circumferentially arcuate body radially inner surface 26 exposed to the engine flowstream during engine operation radially outwardly from rotating blades (not shown). Shroud body 22 can be supported from engine structure in a variety of ways well known and reported in the art (not shown). Each shroud segment body radially outer surface 24 extends at least between a pair of spaced apart, opposed outer surface edge portions. In FIG. 1, one pair extends between a first circumferential outer surface edge portion shown generally at 28 and a second circumferential outer surface edge portion shown generally at 30, spaced apart from and opposed to first outer surface edge portion 28. Outer surface 24 also extends axially between axially spaced apart and opposed edge portions shown generally at 31. In the embodiment of FIG. 1, each of the first and second outer surface edge portions 28 and 30 includes, respectively, a depression portion 32 and 34, respectively, together defining a surface depression 36 bridging an axially extending, circumferential separation 38 between shroud segments 12 and 14. Each depression portion 32 and 34 includes a depression portion seal surface 40 of a first shape, shown in the drawings conveniently to be flat, meaning substantially flat within reasonable tolerance, generally axially along and, in the embodiment of FIG. 1, conveniently axially across each outer surface edge portion 28 and 30. Each depression portion seal surface 40, intended to cooperate with a matching seal surface of a fluid seal member in a shroud assembly, is joined with the shroud body radially outer surface 24 through an arcuate, fillet-type transition surface 42. As used herein, arcuate means generally configured to avoid relatively sharp surface inflection shapes and a potential location of elevated stress concentrations. A depression portion, that generally is shallow in depth, can readily be generated in an outer surface edge portion by such mechanical material removal methods including surface grinding, machining, etc. Alternatively, such surface edge portion can be provided during manufacture of the shroud, for example as in casting.

Figure 2:
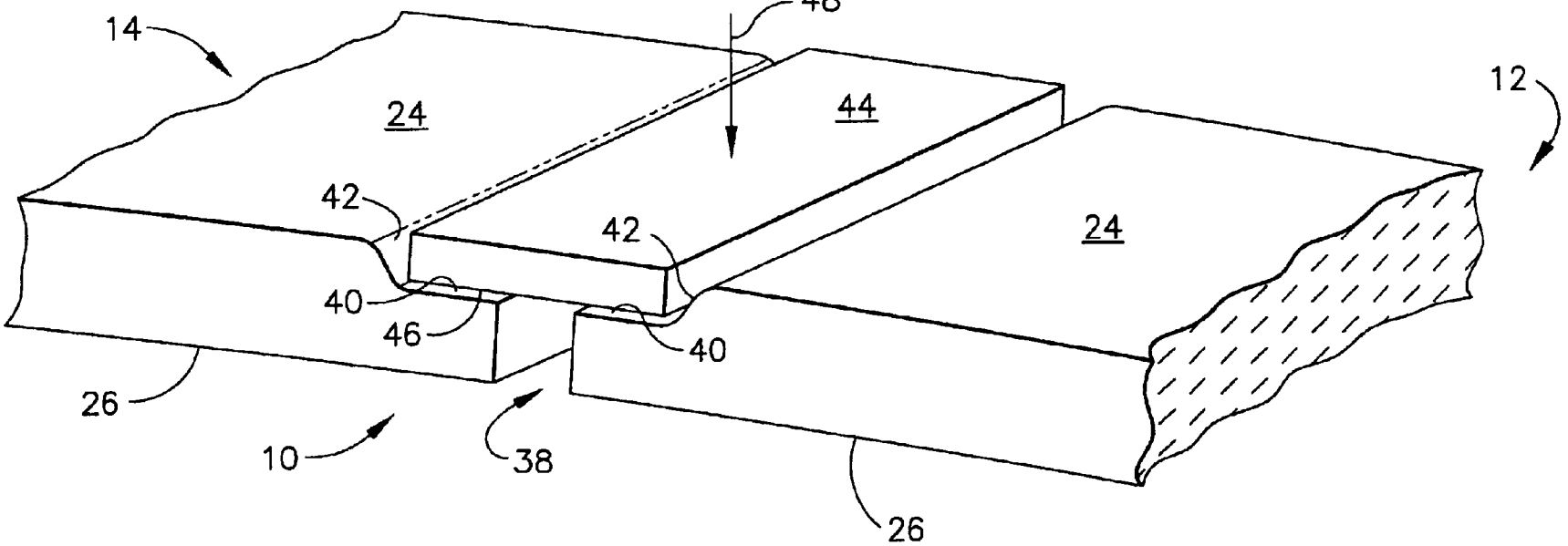
FIG. 2 is a fragmentary perspective partially sectional view of the shroud segments of FIG. 1 in a shroud assembly with a fluid seal disposed and retained in a surface depression defined by juxtaposed edge portion surface depression portions of the segments.
Figure 3:
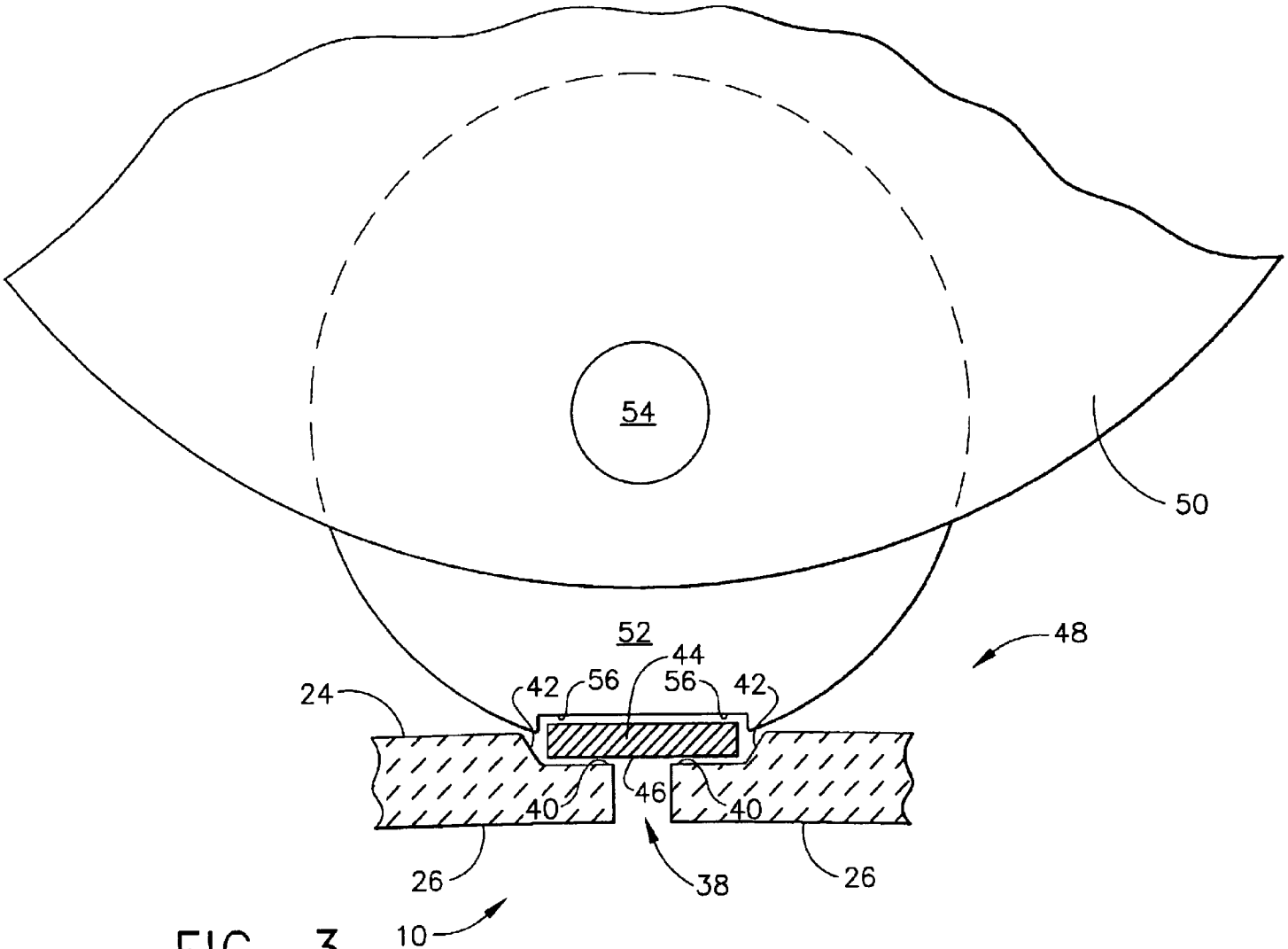
FIG. 3 is a fragmentary, diagrammatic sectional view of the assembly of FIG. 2 showing one form of a seal retainer holding the seal at the shroud segments.

FIG. 2 is a perspective, fragmentary, partially sectional view of an assembly of the segments of FIG. 1 with a fluid seal member 44 extending axially therebetween. FIG. 3 is a fragmentary, diagrammatic sectional view of another embodiment of the assembly of segments of FIG. 1, viewed axially aft looking forward. In FIGS. 2 and 3, fluid seal member 44, shown to be metallic but which can be a CMC material member as desired for enhanced temperature requirements, includes a seal surface 46 of a second shape matched in shape, the meaning of which includes matchable by flexure or distortion, with the first shape of the depression portion seal surfaces 40. As used herein, "matched in shape" means that the shapes of the cooperating juxtaposed seal surfaces are configured, or are sufficiently flexible to enable configuration, to register one with the other to define therebetween a controlled or constant interface contact or spacing. In the embodiments of those figures, and convenient for ease of manufacture, fluid seal member 44 is shown to be a thin, flat metal strip, for example with a thickness in the range of about 0.01–0.05", with a seal surface 46 flat to match the shape of depression portion seal surfaces 40. It should be recognized that the term flat includes minor, insignificant variations. Fluid seal member 44 extends axially along surfaces 40 of juxtaposed segments 12 and 14, bridging separation 38. In the assembly, a seal retainer, represented by force arrow 48 in FIG. 2 and a stepped pin 48 carried by a typical shroud hanger 50 in FIG. 3, retains fluid seal member 44 in depression 36 bridging segments 12 and 14. Cooperating substantially matched shape surfaces 40 and 46 are in juxtaposition to define a fluid pressure drop type of seal therebetween. In the embodiment of FIG. 3, stepped pin retainer shown generally at 48 comprises an enlarged head 52 and a smaller pin portion 54 carried by shroud hanger 50. Head 52 includes a slot 56 sized and shaped to retain fluid seal member 44 at surfaces 40 of depression 36, shown more clearly in FIG. 1, bridging separation 38. Fluid seal member 44 is disposed in depression 36 to retain seal member 44 in circumferential direction 16 in combination with the radial proximity of head 52 and its slot 56.

Although seal retainer 48 holds such members of the assembly in the relative position described above, during engine operation cooling air commonly is applied to shroud segment body radially outer surface 24 and about the radially outer portion of the assembly. Because the pressure of such cooling air is greater than the pressure of engine flowpath fluid at shroud segment body radially inner surface 26, such cooling air pressure loads or presses fluid seal member 44 toward shroud segments 12 and 14, and presses together substantially matched seal surfaces 40 and 46. Such action on the described assembly provides a more efficient pressure drop fluid seal between substantially matched seal surfaces 40 and 46. As was mentioned above, seal member 44 can be made of a CMC material if temperature requirements demand it. In addition, seal member 44 can be relatively flexible or deformable to allow seal member surface 46, as a result of pressure loading, to follow and match the shape of surface 40 during any thermal distortion during operation and pressure loading.

Provision of the shroud segment and assembly of fluid sealed segments, with the sealing combination disposed on radially outward surfaces of the assembly and with the above-described cooperating surface configuration that avoids generation of stress concentrations in the segment, enables practical use of shroud segments made of a low ductility material, for example a CMC. Although the present invention has been described in connection with specific examples, materials and combinations of structures and shapes, it will be understood that they are intended to be typical and representative rather than in any way limiting on the scope of the present invention. Those skilled in the various arts involved, for example relating to turbine engines, to metallic, non-metallic and composite materials, and their combinations, will understand that the invention is capable of variations and modifications without departing from the scope of the appended claims.

What is claimed is:

1. A turbine engine shroud segment comprising a shroud segment body having a radially outer surface extending at least between a pair of first and second spaced apart, opposed outer surface end portions, wherein at least one of the first and second outer edge portions of the radially outer surface in the pair includes a surface depression portion including a depression portion seal surface of a first shape along the depression portion, the depression portion seal surface joined with the shroud body radially outer surface through an arcuate transition surface in which:

the pair of first and second outer surface end portions are spaced apart axially; and, the depression portion seal surface of the depression portion extends circumferentially along the depression portions.

2. The shroud segment of claim 1 in which the shroud segment includes a second pair of first and second outer surface end portions spaced apart circumferentially, with depression portion seal surfaces of the second pair extending axially.

3. The shroud segment of claim 1 in which the first shape of the depression portion seal surface is flat.

4. The shroud segment of claim 1 in which the shroud segment is made of a low ductility material having a tensile ductility measured at room temperature to be no greater than about 1%.

5. The shroud segment of claim 4 in which the low ductility material is a ceramic matrix composite material.

6. A turbine engine shroud assembly comprising a plurality of circumferentially disposed shroud segments, wherein:

each shroud segment comprises a shroud segment body made of a ceramic matrix composite material having a tensile ductility measured at room temperature to be no greater than about 1%, the shroud segment body having a radially outer surface extending at least between a pair of first and second spaced apart, opposed outer surface end portions, at least one of the first and second outer edge portions of the radially outer surface in the pair having a surface depression portion including a depression portion seal surface of a first shape along the depression portion, the depression portion seal surface joined with the shroud body radially outer surface through an arcuate transition surface, with the first and second outer edge portions of a shroud segment being distinct from a surface of a juxtaposed adjacent second member by a separation therebetween; and, a fluid seal member is retained in the surface depression portion and bridges the separation;

the fluid seal member including a fluid seal member surface of a second shape matched in shape with the first shape of the depression portion seal surface and in juxtaposition for contact with the depression portion seal surface along the separation;

the turbine engine shroud assembly including a seal retainer carried by a shroud hanger separate from and unsecured with the ceramic matrix composite material of the shroud segment body, the seal retainer applying a force to the fluid seal member toward the shroud segment to retain the fluid seal member in the surface depression portion.

7. The shroud assembly of claim 6 in which the fluid seal member is sufficiently flexible to enable contact with the depression portion seal surface.

8. The shroud assembly of claim 6 in which:

the pair of first and second outer surface edge portions are spaced apart circumferentially;

the shroud segments are disposed circumferentially with the depression portions of circumferentially adjacent first and second outer edge portions defining therebetween an axially extending surface depression including a depression seal surface of the first shape and an axially extending separation; and, the fluid seal member is disposed axially along the separation.

9. The shroud assembly of claim 6 in which both the first shape of the depression portion seal surface and the second shape of the fluid member seal surface is flat.

10. The shroud assembly of claim 6 in which the seal retainer carried by the shroud hanger is a stepped pin.

11. The shroud assembly of claim 10 in which the stepped pin comprises an enlarged head including a slot sized and shaped to receive and apply force to the fluid seal member.

* * * * *